US005622093A

United States Patent [19]

Hutchins

[11] Patent Number: 5,622,093

[45] Date of Patent: Apr. 22, 1997

[54] AUTOMOBILE WINDSHIELD REMOVAL APPARATUS AND METHOD

[75] Inventor: Mark R. Hutchins, Laconia, N.H.

[73] Assignee: Equalizer Industries, Inc., Round Rock, Tex.

[21] Appl. No.: 375,546

[22] Filed: Jan. 19, 1995

[51] Int. Cl.[6] ..... B26B 3/00; B26D 1/00

[52] U.S. Cl. ..... 83/13; 29/281.1; 29/426.4; 30/116; 30/124; 30/314; 30/372; 30/392

[58] Field of Search ..... 30/116, 124, 296.1, 30/314, 371, 372, 392, 272.1, 275.4; 83/13, 651.1, 56; 29/426.4, 278, 281.1

[56] References Cited

U.S. PATENT DOCUMENTS

| | | | |
|---|---|---|---|
| 809,532 | 1/1906 | Schnackenberg | 30/116 |
| 3,711,677 | 1/1973 | Cummins | 30/116 X |
| 4,199,852 | 4/1980 | Ayers et al. | 30/296.1 X |
| 4,215,475 | 8/1980 | Morford et al. | 30/277 X |
| 4,417,398 | 11/1983 | Steck | 30/116 |
| 4,819,531 | 4/1989 | Lawhon | 30/314 X |
| 4,995,153 | 2/1991 | Asbery | 30/116 |
| 5,421,230 | 6/1995 | Flaherty et al. | 83/13 |

*Primary Examiner*—Eugenia Jones
*Attorney, Agent, or Firm*—Russell D. Culbertson; Shaffer & Culbertson

[57] ABSTRACT

A windshield removal apparatus that includes a suction cup assembly that is secured, via a vacuum, onto the interior center portion of an automobile's windshield. A swivel head is located at the opposite end of the assembly where the vacuum interface is initiated. The swivel head rotates bi-directionally 360 degrees in approximately the same plane as that of the windshield. The rotation of the swivel head is relatively friction free. A spring is located between the swivel head and the cutting wire which is in turn attached to a grip, to complete the configuration of the apparatus. The cutting wire is initially threaded through the seal between the windshield and automobile. The connection of the cutting wire to the spring and swivel head may take place in any order such that the apparatus is in the appropriate position to commence the cutting process of the entire perimeter of the seal. The cutting process involves pulling and releasing of the cutting wire in a series of motions, in which the spring and swivel head work in conjunction to aid in the cutting process. Once the entire perimeter of seal is separated the windshield can be removed from the automobile structure.

5 Claims, 3 Drawing Sheets

AUTOMOBILE WINDSHIELD REMOVAL APPARATUS AND METHOD

FIELD OF THE INVENTION

The invention relates to an apparatus for removing a windshield from an automobile using a wire, and particularly to such an apparatus that allows one person to remove a windshield.

DESCRIPTION OF THE RELATED ART

Automobile windshields must be removed from automobiles on a fairly common basis. The reasons for such removal range from the replacement of a damaged windshield to the salvage of a windshield from a "junkyard" automobile.

The standard method of removal of the windshields involve the use of knifes or power tools to penetrate the perimeter seal between the automobile and windshield. The seal is normally manufactured from a urethane composition. Another method uses piano-type wire which is threaded through the perimeter seal and then two workers, on opposite sides of the glass, saw through the seal to free the windshield. The use of two workers to remove the glass increases the probability that damage to the windshield, automobile or personnel will occur. Further, this substantially increases the cost of the operation due to the necessity of the second person.

Caution must be exercised during the removal process to prevent possible breakage of the glass. With the use of knives or power tools damage to the interior and/or exterior of the automobile may occur, which may be costly to repair. Also, utilization of a sharp instrument, such as a knife or blade, is a potential safety hazard to the personnel performing the work.

There is no device in the prior art that enables an individual to remove a windshield using the wire method without the assistance of another person.

SUMMARY OF THE INVENTION

It is an object of the invention to provide an automobile windshield removal apparatus that can efficiently remove an automobile windshield.

It is another object of the invention to provide a wire-type automobile windshield removal apparatus that increases the success rate of non-breakage of the windshield during the removal process.

It is still another object of the invention to provide a wire-type automobile windshield removal apparatus that eliminates the need of two people to participate in the removal process.

Another object of the invention is to provide an automobile windshield removal apparatus that is typically less expensive than power tools.

It is still another object of the invention to provide an automobile windshield removal apparatus that decreases the chance that damage will occur to the interior or exterior of the automobile.

Finally, it is an object of the invention to provide an automobile windshield removal apparatus that is less dangerous than utilizing knives or blades.

The invention is a device that includes a suction cup assembly that is secured, via a vacuum, onto the interior center portion of an automobile's windshield. A swivel head is located at the opposite end of the assembly where the vacuum interface is initiated. The swivel head rotates bi-directionally 360 degrees in approximately the same plane as that of the windshield. The rotation of the swivel head is relatively friction free. A spring is located between the swivel head and the cutting wire which is in turn attached to a grip, to complete the configuration of the apparatus.

The cutting wire is initially threaded through the seal between the windshield and automobile. The connection of the cutting wire to the spring and swivel head may take place in any order such that the apparatus is in the appropriate position to commence the cutting process of the entire perimeter of the seal. The cutting process involves pulling and releasing of the cutting wire in a series of motions, in which the spring and swivel head work in conjunction to aid in the cutting process. Once the entire perimeter of seal is separated the windshield can be removed from the automobile structure.

DETAILED DESCRIPTION OF THE INVENTION

Figure 1:
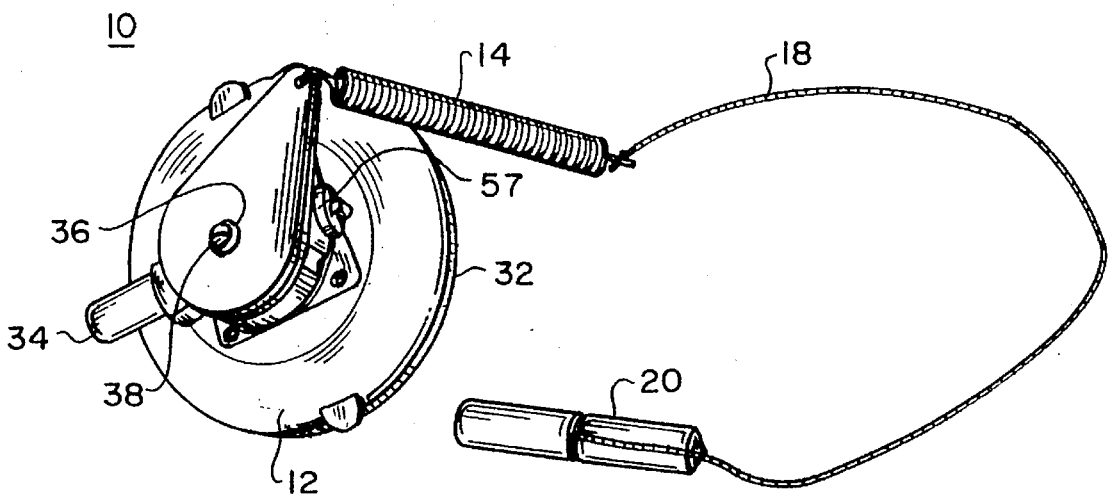
FIG. 1 is an isometric view of the windshield removal apparatus in accordance with the invention.

As shown in FIG. 1, invention 10 has four major components; a suction cup assembly 12, spring 14, cutting wire 18, and a grip 20.

The suction cup assembly 12 is pump activated to create a vacuum between the assembly 12 and the windshield that is attached thereto. While a variety of commercially available devices would be acceptable, preferably, the type of device manufactured by Woods Power Grip, Model TL6AMB is preferable. The vacuum, which should be approximately 70 pounds vertical lifting capacity, secures assembly 12 to the interior of the windshield. The vacuum is obtained by pumping piston 34 which causes the air beneath flexible rubber skirt 32 to be evaucated. The factory issued gripping handle (not shown) is removed and replaced by swivel head plate 13 which is discussed in detail below.

Since the apparatus is held in place by the vacuum during the removal process, it is important that assembly 12 be capable of providing a vacuum that will securely hold invention 10 in place during the removal process. Swivel head plate 13 rotates substantially friction free in either direction for 360 degrees parallel to the plane of the windshield that assembly is attached.

Figure 2:
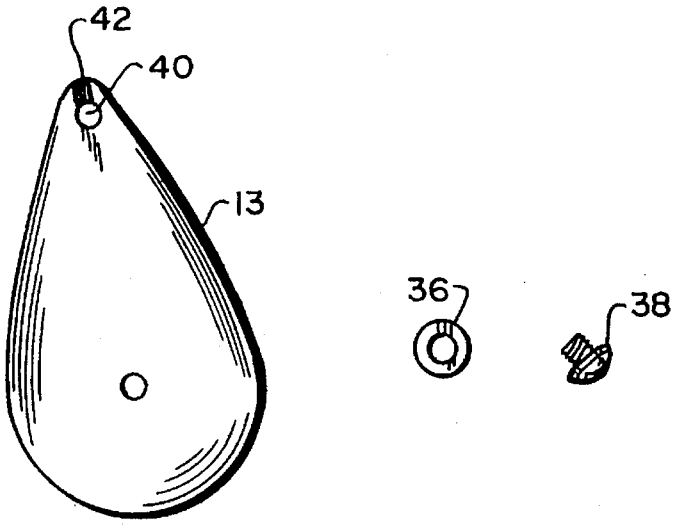
FIG. 2 is a detailed exploded top view of the swivel head plate.

As shown in FIG. 2, plate 13 is fabricated from ¼ inch aluminum plate, fashioned in a tear drop shape. However, this shape and material choice is not critical. Any shape and any material that is sufficiently strong to withstand the forces being exerted on wire 18 and spring 14 and can freely rotate around assembly 12 is suitable.

Swivel head plate 13 is connected to spring 14 via hole 40 and recess 42. An alternative, not shown, would be to connected plate 13 directly to wire 18 and position spring 14 between wire 18 and handle 20. Spring should have sufficient tension to pull wire 18 back to its original position when the pulling force of an operator has been removed. A typical spring 14 may have dimensions #⅝×3¼×0.072, and can be larger or smaller depending on the application.

Attached to the spring 14 is cutting wire 18. Wire 18 should be of sufficient gauge that will effectively and efficiently separate or cut the seal between the windshield and automobile structure. Suitable for use as cutting wire 18 is the type manufactured by Equalizer Industries. However, piano or guitar wire may also be utilized.

Grip 20 is connected to the remaining free end of the cutting wire 18. The type of connection that holds wire 18 to grip 20 is not critical. A preferable choice for grip 20 is Model TWH 500, manufactured by Equalizer Industries since wire 18 can be conveniently and securely attached to grip 18. However, other choices for grip 20 would also be suitable such as a wooden dowel with a hole.

Figure 3:
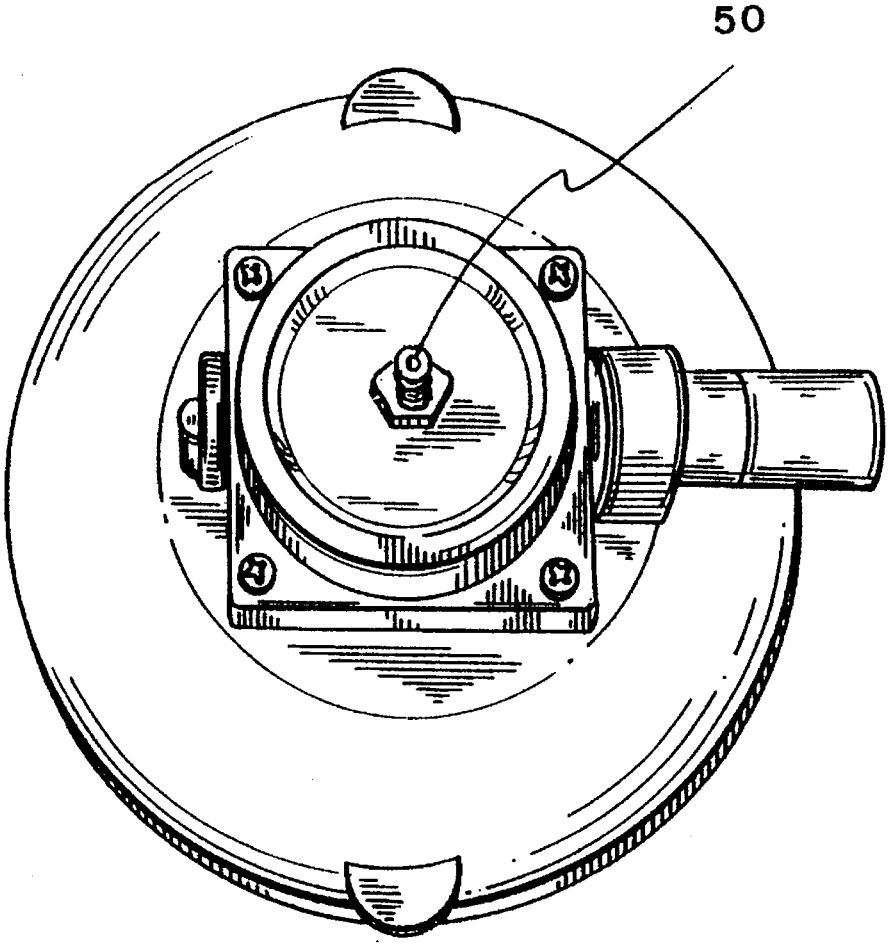
FIG. 3 is a top view of the vacuum assembly with the swivel head plate removed.

FIG. 3 is a top view of suction cup assembly 12 with plate 13 removed. Threaded connection 50, which is customarily used for attaching a handle (not shown) to assembly 12, is used for attaching plate 13.

Figure 4:
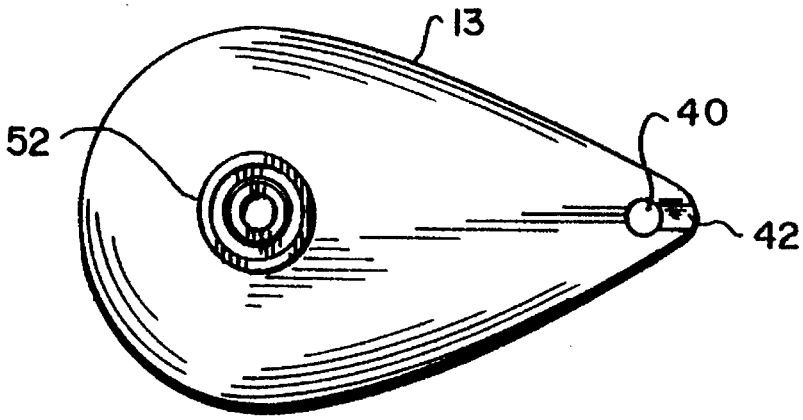
FIG. 4 is a bottom view of the swivel head plate.

FIG. 4 shows a detail bottom view of plate 13. Bearing 52 is fastened within a recess on one side of plate 13 and the plate 13 is attached to threaded connection 50 via machine screw 38 with nylon washer 36 positioned between the bearing 52 and suction cup assembly 12. Bearing 52 is preferably Model 53KDD as manufactured by Fafnir Bearing Company. However, any similar bearing, well known in the art, would also be suitable. In this manner, plate 13 is free to swivel 360 degrees around threaded connection 50, virtually frictionless.

Figure 5:
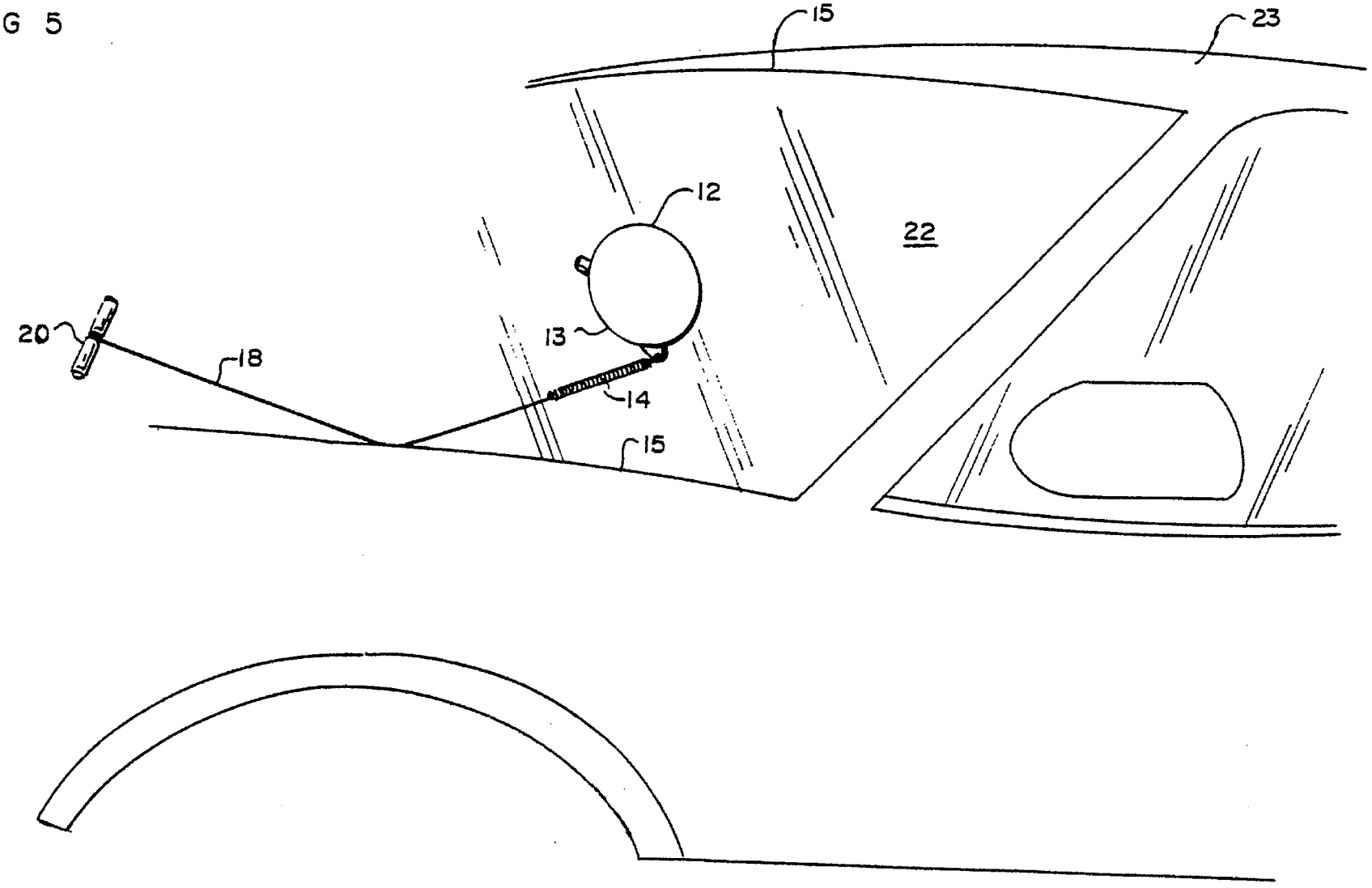
FIG. 5 is an isometric view of the windshield removal apparatus secured to a windshield, with the cutting wire penetrating the seal.

Referring now to FIG. 5, invention 10 is shown secured to automobile 23. To remove windshield 22 from automobile 23, suction cup assembly 12 is secured to the center-interior portion of the windshield 22, by a vacuum means, which is achieved by pumping plunger 34 as discussed above. The vacuum should create a pressure differential sufficient to secure the assembly 12 to the windshield 22 during the removal process. To permit the release of the assembly 12, once the removal process has been completed, valve 57 equalizes the air pressure under skirt 32 to that of the external air pressure, releasing the vacuum interface between the assembly 12 and windshield 22.

The cutting wire 18 initially penetrates seal 15, typically a urethane composition, between the windshield 22 and automobile structure 23. Following the initial penetration, the cutting wire 18 is attached to the swivel head 13 then attached to the grip 20. The order of the connections and initial penetration may be in any order, the only requirement is that the grip 20 be on the exterior portion of the automobile 23 and the assembly 12 secured to the interior of the windshield 22, with the cutting wire 18 attached to the grip 20 and swivel head 13.

With the suction cup assembly 12 secured to the inside surface of the windshield 22, and with the first end of the wire 18 started through the sealant material 15 and connected to grip 20, the user cuts the sealant material 15 by pulling the wire further through the sealant material. The user pulls the wire 18 through at an angle so that the wire presses against the sealant material 15 along one side. Movement of the wire 18 with respect to the sealant material 15 and the force of the wire against the sealant material produces a sawing action which causes the wire to cut through the sealant material as the operator pulls the wire from outside the vehicle.

As the operator pulls the wire 18 through the sealant material 15, the spring 14 attached to the wire stretches and stores energy. When the operator releases tension on the wire 18, the energy stored in the spring 14 pulls the wire back through the opening which has been cut through the sealant material 15. Once the wire 18 is fully retracted so that the spring 14 is relaxed, the operator again pulls the wire 18 through and against the sealant material 15 in the desired cutting direction to produce the sawing action. By alternately pulling the wire 18 through the sealant material in the sawing action and allowing the spring 14 to pull the wire back through the sealant material 15, the operator may eventually cut through the seal around the entire perimeter of the windshield 22. The swivel head 13 rotatably attached to the suction cup assembly 12 rotates with respect to the vacuum assembly to prevent the spring 14 and wire 18 from wrapping around the assembly as the operator cuts the seal around the entire perimeter of the windshield 22.

While there have been described what are present considered to be the preferred embodiments of this invention, it will be obvious to those skilled in the art that various changes and modification may be made therein without departing from the invention and it is, therefore, aimed to cover all such changes and modification as fall within the true spirit and scope of the invention.

What is claimed:

1. A method of cutting sealant material which seals a windshield to an automobile structure, the windshield having an inside surface and an outside surface, the method comprising the steps of:

(a) securing a suction cup assembly on one of said Surfaces of the windshield;

(b) inserting an end of a cutting wire through the sealant material so that the cutting wire traverses the sealant material between the windshield and automobile structure with one end of the cutting wire positioned on one side of the windshield and an other end of the cutting wire positioned on an opposite side of the windshield;

(c) attaching the end of the cutting wire positioned on the side of the windshield to which the suction cup assembly is secured to a spring connected to the suction cup assembly;

(d) applying a pulling force to the end of the cutting wire positioned on the side of the windshield opposite the side to which the suction cup assembly is secured to pull the cutting wire through the sealant material, the pulling force sufficient to stretch the spring connected between the cutting wire and the suction cup assembly;

(e) simultaneously while applying the pulling force, applying a sawing force with the cutting wire along one side of the sealant material adjacent to the cutting wire; and (f) releasing the pulling force on the cutting wire to allow the spring to pull the cutting wire back through the sealant material toward the suction cup assembly secured to the windshield.

2. An apparatus for removing a windshield from an automobile by cutting a sealant material between the windshield and the automobile structure, the apparatus comprising:

(a) a suction cup assembly capable of providing a sufficient vacuum to maintain itself in a stationary position attached to a windshield to be removed;

(b) a swivel head rotatably attached to the suction cup assembly so that the swivel head is rotatable bi-directionally 360 degrees;

(c) a cutting wire having a diameter less than the thickness of the sealant material between the windshield and automobile structure;

(d) a grip releasably connected to a first end of the cutting wire; and (e) a spring connected between the swivel head and an end of the cutting wire opposite the first end of the cutting wire.

3. The apparatus of claim 2 further comprising pump means associated with the suction cup assembly for applying the vacuum for the suction cup assembly.

4. The apparatus of claim 2 wherein the suction cup assembly has at least 70 pounds of vertical lifting capacity.

5. The apparatus of claim 2 wherein the cutting wire is piano wire.

* * * * *